US009675513B2

(12) United States Patent
Vedeloff et al.

(10) Patent No.: US 9,675,513 B2
(45) Date of Patent: Jun. 13, 2017

(54) DEVICE SUITABLE FOR REHABILITATION AND USE THEREOF

(71) Applicant: DYNASPLINT SYSTEMS, INC., Severna Park, MD (US)

(72) Inventors: Russell L. Vedeloff, Stevensville, MD (US); George R. Hepburn, Severna Park, MD (US); Stacey Gausling, Hermosa Beach, CA (US)

(73) Assignee: DYNASPLINT SYSTEMS, INC., Severna Park, MD (US)

( * ) Notice: Subject to any disclaimer, the term of this patent is extended or adjusted under 35 U.S.C. 154(b) by 202 days.

(21) Appl. No.: 13/949,383

(22) Filed: Jul. 24, 2013

(65) Prior Publication Data

US 2015/0031507 A1 Jan. 29, 2015

(51) Int. Cl.

| | |
|---|---|
| ***A63B 23/14*** | (2006.01) |
| ***A63B 23/16*** | (2006.01) |
| ***A63B 21/02*** | (2006.01) |
| ***A61H 1/02*** | (2006.01) |

(52) U.S. Cl.

CPC ... *A61H 1/0288* (2013.01); *A61H 2201/0153* (2013.01); *A61H 2201/1238* (2013.01); *A61H 2201/1253* (2013.01); *A61H 2201/1676* (2013.01)

(58) Field of Classification Search

CPC ..... A63B 21/00; A63B 21/02; A63B 21/05; A63B 21/055; A63B 21/0552; A63B 21/0555; A63B 21/0557; A63B 23/00; A63B 23/12; A63B 23/14; A63B 23/16; A61H 1/0288; A61H 2201/0153; A61H 2201/1238; A61H 2201/1253; A61H 2201/1676

USPC ..... 482/44–50, 92, 121–130

See application file for complete search history.

(56) References Cited

U.S. PATENT DOCUMENTS

| | | | | | |
|---|---|---|---|---|---|
| 2,804,111 | A * | 8/1957 | Burchett | A47J 43/26 | 30/120.3 |
| 2,926,911 | A * | 3/1960 | Reichel | A63B 23/16 | 482/128 |
| 3,664,006 | A * | 5/1972 | Valle | A01K 95/02 | 29/817 |
| 3,916,537 | A * | 11/1975 | Gilligan | A63B 23/16 | 434/258 |

(Continued)

*Primary Examiner* — Stephen Crow
*Assistant Examiner* — Garrett Atkinson
(74) *Attorney, Agent, or Firm* — Hauptman Ham, LLP

(57) ABSTRACT

A system for extending a finger of a hand comprises structural elements configured to be inserted into a flexed finger and capable of providing a controllable force to extend the finger. In some embodiments, structural elements comprise a cam connected to a spacer, the spacer connected to a first strut, and a second strut holding a loading assembly, an end piece and a spring. The loading assembly compresses or relaxes the spring, which exerts a variable force on the end piece, which rotates the cam and the first strut about an extension angle. When the extension angle is minimal, the first and second struts are substantially parallel. A method of extending a finger of a hand substantially fixed in a flexed position comprises inserting a system comprising structural elements into the finger and thereafter providing a force to extend the finger and maintaining the force for a period of time.

20 Claims, 6 Drawing Sheets

(56) References Cited

U.S. PATENT DOCUMENTS 4,513,962 A * 4/1985 Robson ..... A63B 23/16 482/128
4,550,495 A * 11/1985 Fornes ..... A47J 43/26 30/120.3
4,614,034 A * 9/1986 Russell, Jr. ..... A47J 43/26 30/120.3
4,632,384 A * 12/1986 Bright ..... A63B 23/03508 482/49
4,726,580 A * 2/1988 Batiste ..... A63B 21/05 482/122
4,753,434 A * 6/1988 Salvino ..... A63B 23/16 482/121
5,141,478 A * 8/1992 Upper ..... A63B 23/16 482/118
5,147,256 A * 9/1992 Silagy ..... A63B 23/16 482/128
5,409,436 A * 4/1995 Chang ..... A63B 23/16 482/121
5,431,611 A * 7/1995 Silagy ..... A63B 23/16 482/122
5,472,400 A * 12/1995 Royer ..... A63B 21/00047 482/141
6,063,087 A * 5/2000 Agee ..... A61H 1/0288 602/21
6,110,078 A * 8/2000 Dyer ..... A61H 1/0266 482/121
6,565,563 B1 * 5/2003 Agee ..... A61H 1/0288 602/21
6,881,177 B2 * 4/2005 An ..... A63B 21/0004 482/121
7,077,787 B1 * 7/2006 Wiesman ..... A63B 21/025 482/127
8,092,411 B2 * 1/2012 Betcher ..... A61F 5/0118 128/878
9,352,183 B2 * 5/2016 Quinn ..... A63B 21/025
2012/0065026 A1 * 3/2012 Land ..... A63B 21/00065 482/47

* cited by examiner

DEVICE SUITABLE FOR REHABILITATION AND USE THEREOF

BACKGROUND

Abnormal shortening of muscle tissue, rendering the muscle highly resistant to stretching, can lead to a permanent disability. It can be caused by fibrosis of the tissues supporting the muscle or the joint, or by disorders of the muscle fibers themselves. In extreme cases, such conditions are categorized as contractures.

Improper support and positioning of joints affected by arthritis or injury, and inadequate exercising of joints in patients with paralysis can result in contractures. For example, a patient with arthritis or severe burns may assume the most comfortable position and will resist changing position because motion is painful. If the joints are allowed to remain in a single position, the muscle fibers that normally provide motion will stretch or shorten to accommodate the position and eventually will lose their ability to contract and relax.

In some cases, a human hand will remain substantially in a single position. Therapy involves flexing and extending the hand using devices such as DYNASPLINT® devices configured for the hand. Therapy has been successful, even if the patient's hand is in a c-cup position, in which the palm and fingers form an approximation of the letter "c."

In some cases, unfortunately, the fingers of a human hand will remain substantially in a single position mimicking a fist. Although not impossible, flexing and extending a hand on which one or more fingers are so substantially fixed is difficult to achieve with some devices. In such cases, it would be helpful to extend the flexed fingers away from the closed or semi-closed fist position.

By extending the flexed fingers to the point where the hand and fingers are capable to form a c-cup position, it becomes possible to extend and/or flex the hand using a device having a hand piece configured for a c-cup configuration. Indeed, the inventor realized that hands and fingers capable of forming a c-cup are more responsive to hand flexing and extending therapies.

BRIEF DESCRIPTION OF THE DRAWINGS

One or more embodiments are illustrated by way of example, and not by limitation, in the figures of the accompanying drawings, wherein elements having the same reference numeral designations represent like elements throughout and wherein.

DETAILED DESCRIPTION

Figure 1:
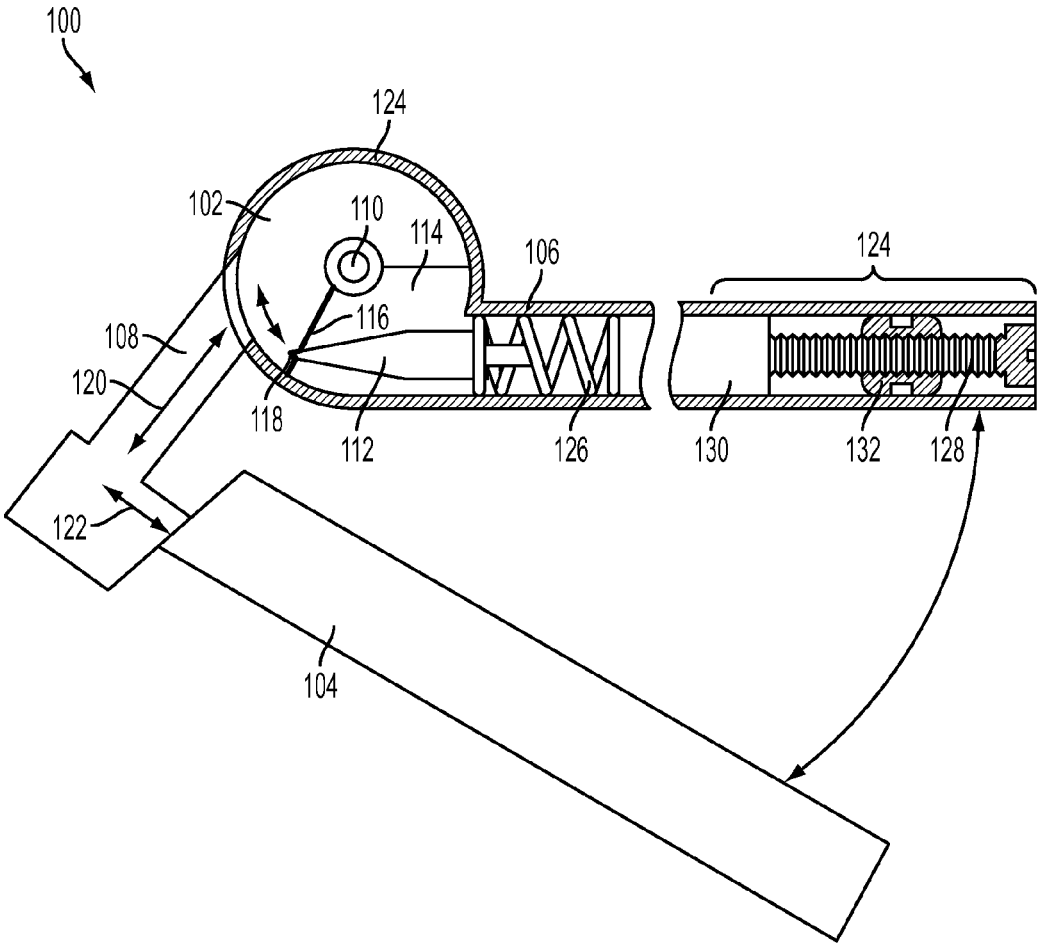
FIG. 1 is a side perspective view of a system for extending a finger of a hand, in some embodiments, wherein a strut and cam housing are broken away to show individual components of the system.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

The present description concerns a device and uses thereof. Although subject to other uses, the device is suitable to extend one or more fingers substantially fixed in a flexed position, e.g., because of contracture.

In some embodiments, the hand is in a closed fist position or a semi-closed fist position. A fisted hand is closed, in which case at least one finger is bent sufficiently to contact the palm with the finger tip. A fisted hand is semi-closed, in which case one or more fingers do not contact the palm but are closer than when in a c-cup position. A fisted hand is considered to be semi-closed if at least one finger has its fingertip within about 38 mm, or 1.5", of the palm. In any case, the closed fist or semi-closed fist position is an involuntary position of the closed or semi-closed fisted hand of a patient such as a human.

In some embodiments, extending a finger of a closed or semi-closed fisted hand from a flexed position improves the range of motion of the joints in the hand and fingers, including but not limited to, the metacarpophalangeal (MCP), proximal interphalangeal (PIP), and distal interphalangeal (DIP) joints. For example, in some embodiments, an MCP range of motion (abduction normally about 0° to 25° in normal healthy individuals) is altered from the closed or semi-closed fist position by as much as 5° or 10° or 15°. For example, in some embodiments, MCP range of motion (extension normally about −90° to +30° in normal healthy individuals) is altered the closed or semi-closed fist position by as much as 120°. For example, in some embodiments, DIP range of motion (Extension/Flexion normally about −80° to +0° for average healthy individuals) is improved from a closed or semi-closed fist position by up to 80°. For example, in some embodiments, PIP range of motion (Extension/Flexion normally about −120° to 0° for average healthy individuals) is improved from a closed or semi-closed fist position by up to 120°.

Systems for improving range of motion of at least one joint in a closed or semi-closed fisted hand comprise structural elements configured to be inserted into at least one flexed finger of the hand and capable of producing a controllable, low-load, prolonged force sufficient to extend the at least one flexed finger of the hand.

Structural elements are any mechanical components that are configurable to be sufficiently narrow to be inserted into at least one flexed finger of a closed or semi-closed fisted hand. In some embodiments, mechanical components are sufficiently narrow to be inserted into a closed fist. In some embodiments, mechanical components are sufficiently narrow to be inserted into a semi-closed fist.

To be configurable to be inserted into at least one flexed finger of a closed or semi-closed fist of a hand, at least one mechanical component of a system is sufficiently rigid to penetrate the inner circumference of the at least one flexed finger of a closed or semi-close fisted hand.

A relevant force is any force directed outwardly from within a flexed finger onto at least a portion of the inner circumference of the flexed finger of a closed or semi-closed fisted hand and at least a portion of the finger, hand, and/or thumb opposite the portion of the at least one flexed finger.

To be controllable, any method of mechanically adjusting at least one structural element is used to vary the relevant force in a predetermined manner. A controllable range includes a low-load force such that the range of force produced corresponds to a force sufficient to result in a range of motion (e.g., stretching, extending, or abduction) of the at least one flexed finger of a closed or semi-closed fisted hand. In some embodiments, the smallest controllable force corresponds to a force sufficient to result in a range of motion (e.g., stretching, extending, or abduction) of at least one flexed finger of a closed fisted hand. In some embodiments, the smallest controllable force corresponds to a force sufficient to result in a range of motion (e.g., stretching, extending, or abduction) of at least one flexed finger of a semi-closed fisted hand. In some embodiments, the largest controllable force corresponds to a force sufficient to result in a range of motion (e.g., stretching, extending, or abduction) of at least one finger approximately in a c-cup position. In other embodiments, the largest controllable force corresponds to a force sufficient to result in a range of motion (e.g., stretching, extending, or abduction) of at least one finger flexed less than or more than a c-cup position.

Control of a force is prolonged such that the force is maintained at a given level based on adjustment of at least one structural element until such time as the at least one structural element is adjusted away from its initial state, in which state the structural element is insertable into the at least one flexed finger of the closed or semi-closed fisted hand.

In some embodiments, the structural element sufficiently rigid to penetrate the inner circumference of the at least one flexed finger of the closed or semi-closed fisted hand is also a structural element capable of producing a controllable, low-load, prolonged force sufficient to extend the at least one flexed finger of the hand. In other embodiments, the structural element sufficiently rigid to penetrate the inner circumference of the at least one flexed finger of the closed or semi-closed fisted hand is a separate element from a structural element capable of producing a controllable, low-load, prolonged force sufficient to extend the at least one flexed finger of the hand.

In some embodiments, structural elements comprise a spreader, which comprises a first strut and a second strut, wherein the first strut and the second strut come together in a narrow tip sufficient to be inserted into the at least one flexed finger of the closed or semi-closed fisted hand. In some embodiments, the spreader uses hydraulic pressure, bladder mechanisms, spring loaded mechanisms, a ratchet mechanism, a collapsible framework mechanism, or a caliper mechanism to separate or spread the first strut and the second strut, thereby providing the controllable, low-load, prolonged force.

In some embodiments, structural elements comprise a first strut and a second strut, wherein the first strut and the second strut pivot about a fulcrum, and wherein the first strut and the second strut are configured to come together in a narrow tip sufficient to be inserted into the at least one flexed finger of the closed or semi-closed fist of a hand. In some embodiments, the lever uses a hydraulic pressure mechanism, a bladder mechanism, a spring loaded mechanism, a spring loaded mechanism, a ratchet mechanism, a collapsible framework mechanism, or a caliper mechanism to separate or spread the first strut and the second strut, thereby providing the controllable, low-load, prolonged force.

In some embodiments, at least one of the arms (the first strut and the second strut) is substantially flat to accommodate placement in the at least one finger substantially fixed in a flexed position on the closed or semi-closed fist. In some embodiments, at least one of the arms is substantially round or oval to accommodate placement in the at least one finger substantially fixed in a flexed position on the closed or semi-closed fisted hand.

In some embodiments, structural elements comprise an air bladder, configured to be inserted into the at least one flexed finger of a closed or semi-closed fisted hand. In some embodiments, a controllable, low-load, prolonged force is providable by air or other gas inserted into the bladder. In some embodiments, the air bladder is sufficiently rigid to penetrate the inner circumference of the at least one flexed finger of a closed or semi-closed fist of a hand. In other embodiments, at least one separate structural element is sufficiently rigid to penetrate the inner circumference of the at least one flexed finger of a hand. The inflatable air bladders are usually an elastic material, e.g., rubber, and used to lift or push the at least one flexed finger during operation.

Referring to FIG. 1, a system 100 for extending a finger of a closed or semi-closed fisted hand includes cam 102 that provides a pivot point for first strut 104 and second strut 106. To provide a pivoting function, cam 102 is rigidly linked to first strut 104 by spacer 108 and rotates about axis 110 held by second strut 106. Cam 102 has the general form of a disc modified to accommodate end piece 112, which is in communication with cam 102 to rotate cam 102 about axis 110. In some embodiments, a modification of the disc shape comprises one or more recessed portions, one or more projections, additional features such as indentations or pins, or any combination thereof. In the embodiment depicted in FIG. 1, e.g., cam 102 has recessed area 114 defined in part by cam surface 116, which has indentation 118. In use, end piece 112 applies a force to cam 102 at indentation 118 to rotate cam 102 about axis 110.

Cam 102 is constructed of any material having sufficient strength to extend a finger substantially fixed in a flexed position. In some embodiments, the material is chosen from plastics, metals, and combinations thereof. In some embodiments, cam 102 is or comprises stainless steel. Cam 102 is sufficiently large to handle the forces exerted by end piece 112 but not so large as to make system 100 unwieldy or excessively heavy. In one embodiment, cam 102 has a largest dimension ranging from 10 mm to 40 mm. In some embodiments, the dimension ranges from 15 to 35 mm or from 20 to 30 mm.

Spacer 108 leverages the rotation of cam 102 onto first strut 104 and aligns first strut 104 relative to second strut 106. Spacer 108 has dimensions 120 and 122 which allow first strut 104 to clear housing 124, which encloses cam 102 and in some embodiments has outer dimensions larger than those of second strut 106. In some embodiments, dimension 120 is perpendicular to dimension 122. In one embodiment, dimension 120 ranges from 5 mm to 20 mm. In some embodiments, dimension 122 independently ranges from 10 mm to 30 mm. In some embodiments, spacer 108 is not present and cam 102 is directly linked to first strut 104.

Spacer 108 is constructed of any material having sufficient strength to extend a finger substantially fixed in a flexed position. In some embodiments, the material is chosen from plastics, metals, and combinations thereof. In some embodiments, spacer 108 is or comprises stainless steel.

Spacer 108 is connected to cam 102 by any means that fixes their relative positions such that, in use, cam 102 and spacer 108 rotate together about axis 110. In some embodiments, the spacer 108 and cam 102 are one piece. In various embodiments, cam 102 and spacer 108 are directly or indirectly connected. In some embodiments, direct or indirect connections are made using additional hardware. In some embodiments, cam 102 and spacer 108 are made of different materials. In other embodiments, cam 102 and spacer 108 are made of the same material. In the embodiment depicted in FIG. 1, e.g., cam 102 and spacer 108 are formed as a single piece.

First strut 104 extends from spacer 108, or in some embodiments, the spacer 108 is absent and the first strut 104 extends directly from cam 102. In use, rotation of cam 102 and spacer 108 about axis 110 corresponds to separation of first strut 104 from second strut 106. In some embodiments, first strut 104 extends from spacer 108 in the direction of dimension 122. In use, separation of first strut 104 and second strut 106 acts to open a closed or semi-closed fist by extending one or more fingers of the hand.

First strut 104 is constructed of any material having sufficient strength to extend a finger substantially fixed in a flexed position. In some embodiments, the material is chosen from plastics, metals, and combinations thereof. In some embodiments, first strut 104 is or comprises stainless steel.

In various embodiments, first strut 104 is sufficiently long to accommodate substantially all human hand sizes. In various embodiments, first strut 104 is sufficiently thin to be inserted into at least one finger of a closed or semi-closed fist of an adult, child, or infant human hand. First strut 104 is not so large as to make system 100 unwieldy or excessively heavy. In one embodiment, first strut 104 has a largest dimension ranging from 50 mm to 140 mm. In one embodiment, first strut 104 has a width ranging from 5 mm to 20 mm.

First strut 104 is connected to spacer 108 or cam 102 by any means that fixes their relative positions such that, in use, cam 102, spacer 108 (if present), and first strut 104 rotate together about axis 110. In various embodiments, first strut 104 and spacer 108 are directly or indirectly connected. In some embodiments, direct or indirect connections are made using additional hardware. In various embodiments, the connection between first strut 104 and spacer 108 is the same as or different from the connection between spacer 108 and cam 102. In some embodiments, first strut 104 and spacer 108 are made of different materials. In other embodiments, first strut 104 and spacer 108 are made of the same material. In various embodiments, first strut 104, spacer 108, and cam 102 comprise one, two, or three separate pieces. In the embodiment depicted in FIG. 1, e.g., first strut 104, spacer 108, and cam 102 are formed as a single piece.

Second strut 106 comprises a housing 124 and an elongated portion extending from housing 124 along a major axis. The elongated portion is aligned with cam 102 such that cam 102 rotates about axis 110 in response to a force applied along the major axis. In use, second strut 106, by holding axis 110 in place, allows cam 102, spacer 108 (if present), and first strut 104 to separate from second strut 106, thereby acting to open a closed or semi-closed fist by extending one or more fingers of the hand, as described elsewhere.

Second strut 106 is constructed of any material having sufficient strength to extend a finger substantially fixed in a flexed position. In some embodiments, the material is chosen from plastics, metals, and combinations thereof. In some embodiments, second strut 106 is or comprises stainless steel.

In various embodiments, second strut 106 is sufficiently long along the major axis of the elongated portion to accommodate substantially all human hand sizes. In various embodiments, second strut 106 is sufficiently thin to be inserted into at least one finger of a closed or semi-closed adult, child, or infant human hand. Second strut 106 is not so large as to make system 100 unwieldy or excessively heavy. In one embodiment, second strut 106 has a largest dimension ranging from 50 mm to 150 mm. In one embodiment, second strut 106 has a width ranging from 5 mm to 20 mm.

Second strut 106 holds loading assembly 124, end piece 112, and spring 126 between loading assembly 124 and end piece 112. Loading assembly 124 is a mechanical assembly for applying an adjustable force along the major axis of second strut 106 and is positioned at or near the end of second strut 106 distal to axis 110. Loading assembly 124 comprises any components capable of translating a user set-point into a position along the major axis of second strut 106. In the embodiment depicted in FIG. 1, e.g., loading assembly 124 comprises screw 128 and intermediate member 130. Screw 128 is threaded into screw thread 132, held in place by second strut 106.

In use, the distal end of screw 128 is rotated by a user such that screw thread 132 translates rotational position of screw 128 into linear position relative to the major axis of second strut 106. Screw 128 is any type of screw suitable for matching to screw thread 132 and rotatable from the end of second strut 106 distal to axis 110. In various embodiments, screw 128 is an Allen head, Phillips head, or slotted head screw. In various embodiments, in use, a user rotates screw 128 with or without the use of a screwdriver or other tool. In the embodiment depicted in FIG. 1, e.g., screw 128 is a slotted head screw and a user rotates screw 128 using a screwdriver.

Screw 128 is constructed of any material having sufficient strength to exert a force so as to extend a finger substantially fixed in a flexed position. In some embodiments, the material is chosen from plastics, metals, and combinations thereof. In some embodiments, screw 128 is or comprises stainless steel.

Intermediate member 130 is any mechanical piece capable of movement along the major axis of second strut 106 so as to translate, in use, linear movement of screw 128 onto spring 126.

Intermediate member 130 is constructed of any material having sufficient strength to exert a force so as to extend a finger substantially fixed in a flexed position. In some embodiments, the material is chosen from plastics, metals, and combinations thereof. In some embodiments, intermediate member 130 is or comprises stainless steel.

Spring 126 is any mechanical piece or device that follows Hooke's law or demonstrates similar elastic behavior through compression and relaxation. In use, spring 126 translates the adjustable position asserted by loading assembly 124 into a variable force on end piece 112 along the major axis of second strut 106. Force variability derives from the elastic behavior of spring 126 and, in use, centers on a value determined by the degree of compression or relaxation established by loading assembly 124. In the embodiment depicted in FIG. 1, e.g., spring 126 is a single piece, helical spring, is compressed or relaxed by intermediate piece 130, and exerts a variable force on end piece 112.

Spring 126 is constructed of any material having sufficient strength to exert a force so as to extend a finger substantially fixed in a flexed position. In some embodiments, the material is chosen from plastics, metals, reinforced composites, and combinations thereof. In some embodiments, spring 126 is or comprises stainless steel.

End piece 112 is any mechanical piece capable of movement along the major axis of second strut 106 so as to translate, in use, variable force exerted by spring 126 onto cam 102. End piece 112 and cam 102 are configured to match such that end piece 112 is in communication with cam 102 to rotate cam 102 about axis 110 in response to application of the translated variable force by end piece 112. Communication is by any suitable mechanical combination and in some embodiments includes additional mechanical pieces. End piece 112 is shaped to abut spring 126 on one end and communicate with cam 102 on the opposite end, having a form suitable to the mechanical combination used to communicate with cam 102. In the embodiment depicted in FIG. 1, e.g., end piece 112 has the form of a chisel tip with a point that, in use, contacts indentation 118 to rotate cam 102 about axis 110.

End piece 112 is constructed of any material having sufficient strength to exert a force so as to extend a finger substantially fixed in a flexed position. In some embodiments, the material is chosen from plastics, metals, and combinations thereof. In some embodiments, end piece 112 is or comprises stainless steel.

Second strut 106 holds loading assembly 124, end piece 112, and spring 126 so as to achieve the configuration described above. In some embodiments, loading assembly 124, end piece 112, and spring 126 are external to second strut 106. In other embodiments, second strut 106 comprises an at least partially hollow elongated section, such as a tube, housing loading assembly 124, end piece 112, and spring 126. In the embodiment depicted in FIG. 1, e.g., second strut 106 comprises a hollow tube within which intermediate piece 130, spring 126, and end piece 112, when in use, move linearly along the inner diameter of second strut 106 as controlled by the rotational position of screw 128.

Figure 2:
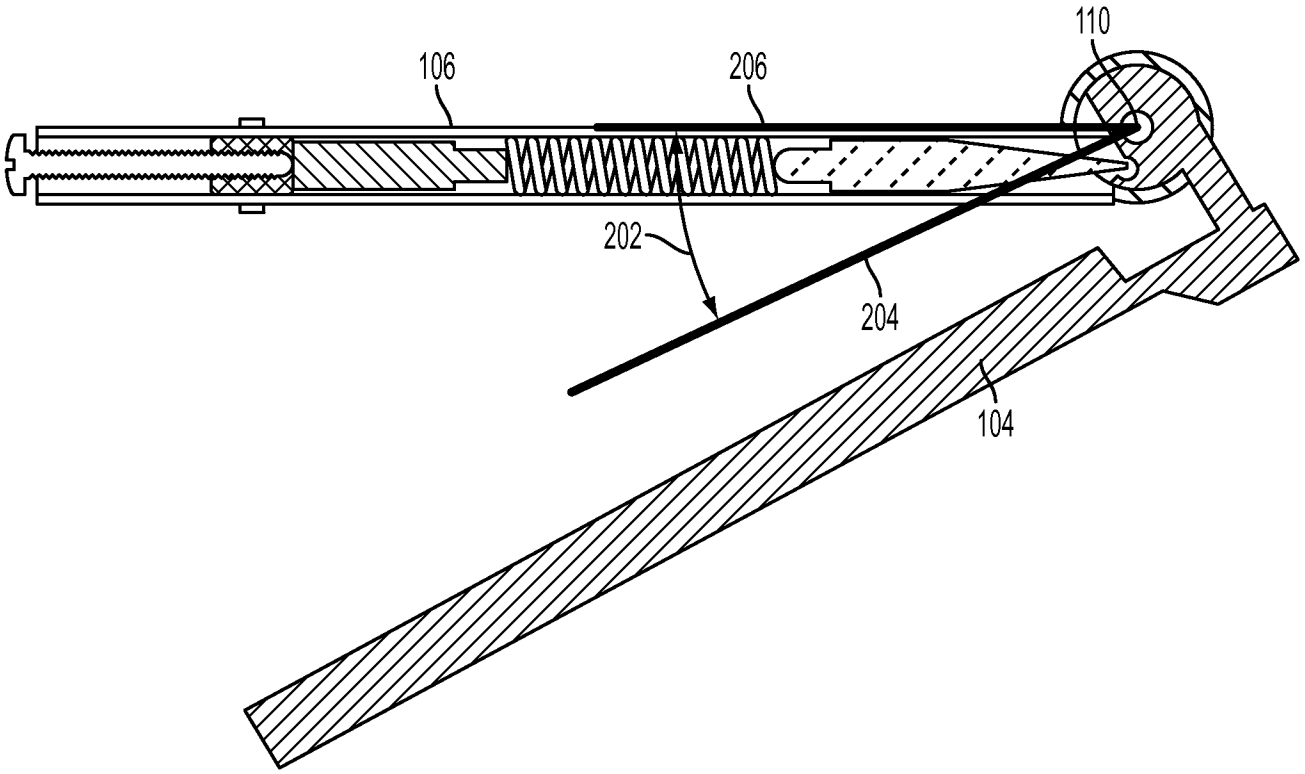
FIG. 2 is a side perspective view of a system for extending a finger of a hand, in some embodiments, showing the relative positions of two struts and the resultant extension angle.

Through the pivoting mechanical connection provided by cam 102 and spacer 108 (if present) first strut 104 and second strut 106 form extension angle 202, illustrated in an example embodiment in FIG. 2. Extension angle 202 defines the degree of extension of first strut 104 relative to second strut 106. In use, this degree of extension determines the degree to which a finger of a hand is extended by system 100.

The minimal extension angle 202 corresponds to a configuration in which first strut 104 and second strut 106 are substantially parallel. In some embodiments, the extension angle, in use, ranges from approximately 0° to approximately 90°. In some embodiments, the extension angle, in use, ranges from 5° to 90°, or from 10° to 80°, or from 20° to 70°, or from 30° to 60°, or from 40° to 50°. In some embodiments, the extension angle, in use, ranges from that sufficient to be inserted into a closed or semi-closed fist to approximately 45°.

In the example embodiment of FIG. 2, line segment 204 is parallel to the major axis of first strut 104 and originates at axis 110. Line segment 206 is parallel to the major axis of second strut 106 and also originates at axis 110. Line segments 204 and 206 thereby form extension angle 202 with a vertex at axis 110. In various embodiments, line segment 204, line segment 206, and axis 110 have any configuration such that first strut 104 and second strut 106 form extension angle 202.

In use, to facilitate insertion of system 100 into a closed or semi-closed fist, when extension angle 202 is minimal, first strut 104 and second strut 106 are substantially parallel. In this configuration, further facilitation is provided by first strut 104 and second strut 106 having a combined cross-sectional dimension sufficient to be inserted into a closed or semi-closed fist. In some embodiments, the combined cross-sectional dimension ranges from 5 mm to 20 mm.

In some embodiments, minimal extension angle 202 corresponds to the minimal force exerted on cam 102 by end piece 112. In some embodiments, the minimal force exerted on cam 102 is substantially zero. In some embodiments, the minimal force exerted on cam 102 corresponds to a non-zero value such that the minimal extension angle 202 is achieved while spring 126 is in compression.

In some embodiments in which end piece 112 has the form of a chisel tip, the minimal extension angle 202 is achievable with end piece 112 in contact with cam 102. In some embodiments in which end piece 112 has the form of a chisel tip, the minimal extension angle 202 is achievable without end piece 112 in contact with cam 102.

Figure 3:
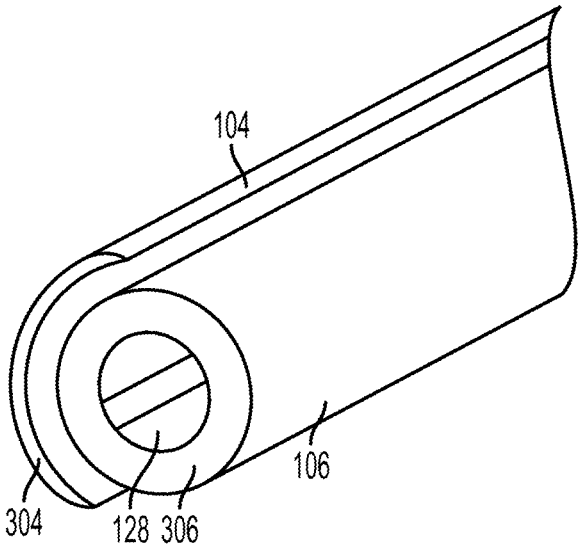
FIG. 3 is an angled end view of a system for extending a finger of a hand, in some embodiments, showing overlapping struts.

FIG. 3 depicts an embodiment in which first strut 104 comprises a concave surface proximal to second strut 106. In this embodiment, the inner dimension of the concave surface of first strut 104 has a circular cross-section with a diameter that approximately matches the outer surface diameter of second strut 106 such that, when extension angle 202 is minimal, first strut 104 substantially overlaps second strut 106. In this configuration, the combined cross-sectional dimension of first strut 104 and second strut 106 is minimized so as to facilitate insertion of system 100 into a closed or semi-closed fist.

In other embodiments, first strut 104 and second strut 106 have any compatible cross-sectional profile so as to at least partially overlap when extension angle 202 is minimal. In still other embodiments, first strut 104 and second strut 106 do not overlap.

Referencing FIG. 3, first strut 104 comprises end 304 distal to axis 110 and second strut 106 comprises end 306 distal to axis 110. In one embodiment, when extension angle 202 is minimal, end 304 and end 306 are approximately aligned. In some embodiments, when extension angle 202 is minimal, end 304 and end 306 are not aligned. In some embodiments, at least one of first strut 104 and second strut 106 is adjustable, for example by a telescope configuration, such that when extension angle 202 is minimal, alignment of end 304 and end 306 is variable.

In some embodiments, to further facilitate insertion into a closed or semi-closed fist, at least one of first strut 104 and second strut 106 comprises a low-friction outer surface. In some embodiments, the low-friction outer surface comprises a low-friction material. In one embodiment, the low-friction material is Teflon.

Figure 4:
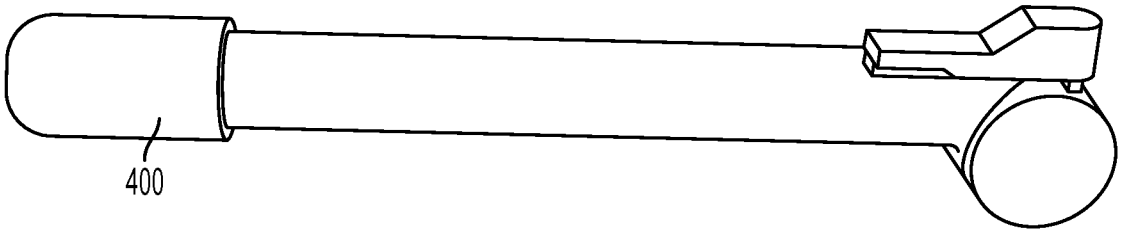
FIG. 4 is a side perspective view of a system for extending a finger of a hand in some embodiments, showing a cap fitted over the ends of two struts.

In some embodiments, such as the example embodiment depicted in FIG. 4, a system for extending a finger of a hand comprises a kit that also includes cap 400 shaped to fit over first strut 104 and second strut 106 when extension angle 202 is minimal. Cap 400 has a shape that conforms to the profiles of end 304 and end 306 so that, in use, cap 400 encloses first strut 104 at end 304 and second strut 106 at end 306 without adding substantially to the combined cross-sectional dimension as described in previous paragraphs. In the embodiment depicted in FIG. 4, e.g., cap 400 is a cylinder closed on one end that, in use, encircles first strut 104, concavely fitted to and overlapping second strut 106 to form an approximately circular profile. In other embodiments, cap 400 is shaped to fit over first strut 104 and second strut 106 having a combined profile other than approximately circular, such as a substantially square or triangular profile.

In use, cap 400 facilitates insertion of first strut 104 and second strut 106 into a closed or semi-closed fist. Cap 400 provides a single, undivided surface to the inside of a flexed finger of a hand, acting as a layer of protection during insertion. Application of cap 400 reduces the possibility of any gap between first strut 104 and second strut 106 or any exposed portion of loading assembly 124 from catching on part of a hand or finger. Once first strut 104 and second strut 106 are fully inserted into at least one finger of the closed or semi-closed fist, removal of cap 400 allows extension angle 202 to be increased away from its minimal value.

Cap 400 is constructed of any material having sufficient strength to hold first strut 104 and second strut 106 in place while being inserted into a closed or semi-closed fist. Cap 400 also comprises a low-friction outer surface. In some embodiments, the material is chosen from plastics, metals, and combinations thereof. In some embodiments, cap 400 is or comprises plastic.

In some embodiments, in use, cap 400 also facilitates pre-loading tension on spring 126 by maintaining a substantially minimal extension angle with loading assembly 124 adjusted to apply a force that would otherwise correspond to an increase above the minimal extension angle. With first strut 104 and second strut 106 held in place by cap 400, increased force exerted through a given adjustment of loading assembly 124 translates to compression of spring 126. At the given adjustment level, first strut 104 and second strut 106 separate to an increased extension angle without the presence of cap 400 or other constraint. In these embodiments, cap 400 is constructed of any material having sufficient strength to hold first strut 104 and second strut 106 in place with tension on spring 126 sufficient to exert a force so as to extend a finger substantially fixed in a flexed position.

Figure 5:
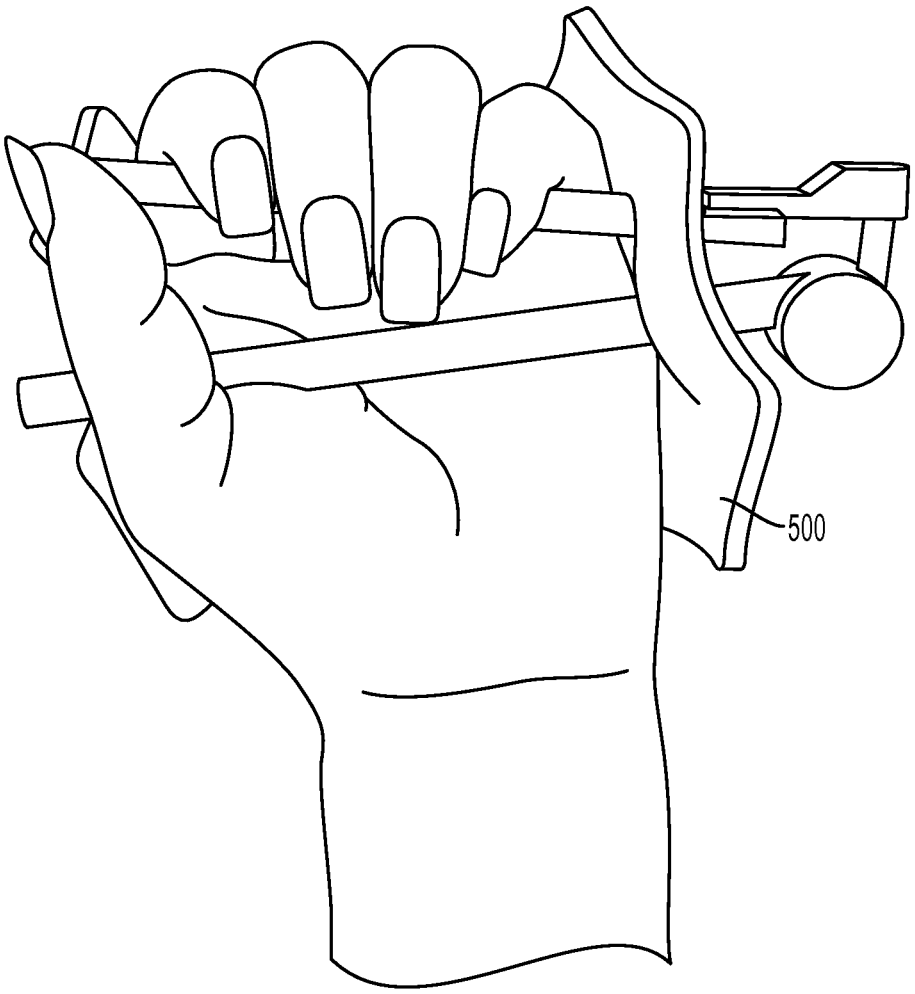
FIG. 5 is a perspective view showing a system for extending a finger of a hand being held in place by a strap, in some embodiments.

In some embodiments such as the example embodiment illustrated in FIG. 5, a system for extending a finger of a hand comprises a kit that also includes strap 500 capable of holding first strut 104 and second strut 106 in place relative to the hand. Strap 500 comprises a slot or similar opening capable of capturing at least one of first strut 104 and second strut 106 at the end proximal to axis 110, corresponding to the vertex of extension angle 202. Strap 500 further comprises a slot or similar opening capable of capturing either one of first strut 104 or second strut 106 near end 304 or end 306, respectively, corresponding to the end distal to axis 110.

In use, strap 500 is positioned around the outside of a closed or semi-closed fist with one end capturing at least one of first strut 104 and second strut 106 near axis 110 and the other end capturing either one of first strut 104 or second strut 106 away from axis 110. In this configuration, first strut 104 and second strut 106 are held in place relative to the hand, as depicted in FIG. 5.

Strap 500 is constructed of any material or materials having sufficient strength to hold first strut 104 and second strut 106 in place relative to a hand while having sufficient flexibility to extend around the hand. In some embodiments, the material or materials are chosen from synthetics, natural materials, plastics, elastics, and combinations thereof. In some embodiments, strap 500 is or comprises synthetic plastic.

The present description also concerns a method of extending at least one finger substantially fixed in a flexed position, comprising inserting a system comprising structural elements into the finger and thereafter controlling the structural elements to provide a force to extend the at least one finger.

When the structural elements are inserted into the at least one finger substantially fixed in a flexed position, the elements are positioned such that when the force is provided, the at least one finger is extended or stretched for a period of time sufficient to lengthen the muscles associated with the at least one finger being substantially fixed in a flexed position. After a period of time, the force is reduced to a level sufficient to remove the structural elements from the extended or stretched at least one finger. The extending or stretching, in some embodiments is repeated for completing a set of exercises and/or in some embodiments, the extending or stretching is repeated as part of a regimen lasting a day, a week, a month, or a year.

Although the method of extending at least one finger substantially fixed in a flexed position is described in reference to a device described above, the method is practicable by other devices, especially those herein, and as such the method is not limited to the device described below for illustrating the method.

Figure 6:
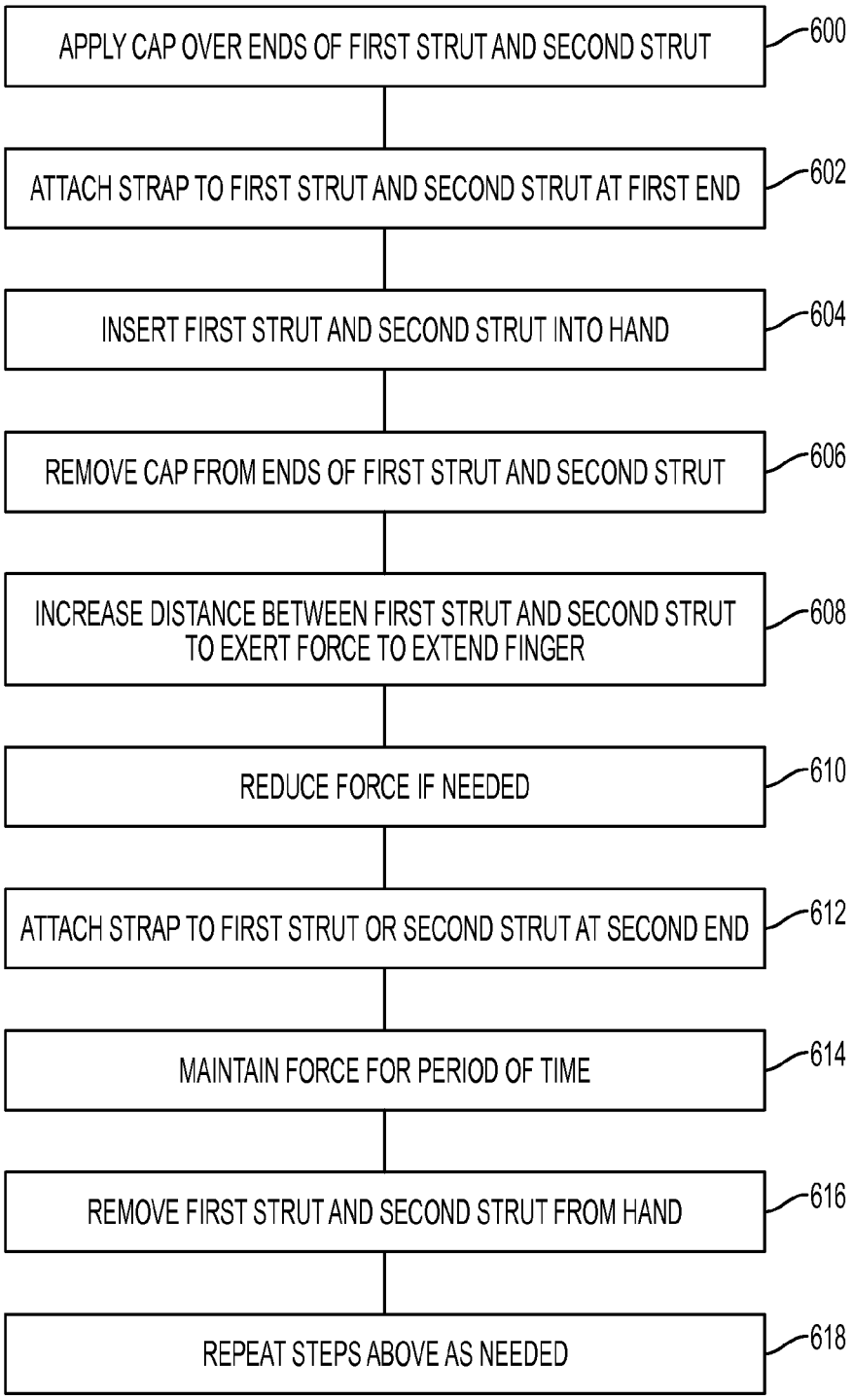
FIG. 6 is a flow chart for a method of extending a finger of a hand in some embodiments.

FIG. 6 is an example embodiment of a method of extending a finger of a hand from a flexed position. In some embodiments, the hand is in a closed fist position or a semi-closed fist position.

Extending a finger of a hand from a flexed position can improve the range of motion of the joints in the hand and fingers, including but not limited to, the metacarpophalangeal (MCP), proximal interphalangeal (PIP), and distal interphalangeal (DIP) joints.

By extending the flexed fingers even temporarily, caregivers can access parts of the hand that would otherwise be inaccessible. For example, in some embodiments, care giving to the fingernails of temporarily extended fingers is provided, e.g., by trimming the length of the fingernails or by providing first-aid to sores on the hand or fingers during the period time the sores are exposed for treatment due to the extension of the at least one finger on the fisted hand.

In some embodiments, a method of extending a finger of a hand comprises step 600 in which cap 400 is applied over ends of first strut 104 and second strut 106. In some embodiments, the ends of first strut 104 and second strut 106 are the ends away from axis 110. Applying cap 400 includes any method of securing cap 400 over the ends of first strut 104 and second strut 106 such that first strut 104 and second strut 106 are held in place by cap 400. In some embodiments, applying cap 400 comprises placing cap 400 over the ends of first strut 104 and second strut 106 with loading assembly 124 adjusted to apply a force corresponding to the minimal extension angle.

In other embodiments, applying cap 400 comprises placing cap 400 over the ends of first strut 104 and second strut 106 with loading assembly 124 adjusted to apply a force that would otherwise correspond to an increase above the minimal extension angle. In these embodiments, cap 400 is positioned over the ends of first strut 104 and second strut 106 while first strut 104 and second strut 106 are held together by a force applied externally. In some embodiments, the external force is applied by a human hand.

Similarly, in some embodiments in which a first strut and a second strut are separated by a force producible by a spreader, applying a cap comprises placing one or two caps over one or both ends of the first strut and the second strut with the spreader adjusted to apply a force corresponding to a minimal spread between the first strut and the second strut. In other embodiments, applying caps comprises placing one or two caps over one or both ends of the first strut and the second strut with the spreader adjusted to apply a force that would otherwise correspond to an increase above the minimal spread. In these embodiments, the one or two caps are positioned over the ends of the first strut and the second strut while the first strut and the second strut are held together by a force applied externally. In some embodiments, the external force is applied by a human hand.

In some embodiments, a method of extending a finger of a hand comprises step 602 in which strap 500 is attached to at least one of first strut 104 and second strut 106 at or near a first end. In some embodiments, strap 500 is attached to at least one of first strut 104 and second strut 106 near axis 110. In various embodiments, strap 500 is attached to first strut 104, second strut 106, or both first strut 104 and second strut 106.

Attaching strap 500 includes any method of securing strap 500 on at least one of first strut 104 and second strut 106 such that a force can be applied to hold first strut 104 and second strut 106 in place relative to a hand. In some embodiments, strap 500 is attaches to at least one of first strut 104 and second strut 106 by passing at least one of first strut 104 and second strut 106 through a slotted opening in strap 500.

Referring to FIG. 6, a method of extending a finger of a hand comprises step 604 in which first strut 104 and second strut 106 are inserted into a closed or semi-closed fist. Inserting comprises pushing first strut 104 and second strut 106 through a finger of a closed or semi-closed fist. Either end of first strut 104 and second strut 106 is inserted first. In some embodiments, inserting comprises pushing first strut 104 and second strut 106 through a flexed finger with cap 400 applied to first strut 104 and second strut 106. In other embodiments, inserting comprises pushing first strut 104 and second strut 106 through a flexed finger with no cap applied to first strut 104 and second strut 106.

In some embodiments, step 604 comprises inserting first strut 104 and second strut 106 into the end of a closed or semi-closed fist away from the thumb. In other embodiments, step 604 comprises inserting first strut 104 and second strut 106 into the end of a closed or semi-closed fist nearest the thumb.

In some embodiments, step 604 comprises inserting first strut 104 and second strut 106 to such an extent that first strut 104 and second strut 106 protrude from both ends of a closed or semi-closed fist. In other embodiments, step 604 comprises inserting first strut 104 and second strut 106 to the extent that only one end of first strut 104 and second strut 106 protrudes from a closed or semi-closed fist.

In some embodiments in which cap 400 has been applied, a method of extending a finger of a hand comprises step 606 in which cap 400 is removed from the ends of first strut 104 and second strut 106. In some embodiments, removal of cap 400 corresponds to extension angle 202 remaining at a minimal value. In some embodiments in which tension on spring 126 has been pre-loaded as described in previous paragraphs, removal of cap 400 corresponds to extension angle 202 increasing above a minimal value.

Similarly, in some embodiments in which a first strut and a second strut are separated by a force producible by a spreader, removing a cap comprises removing the one or two caps from one or both ends of the first strut and the second strut. In some embodiments, removal of the one or two caps corresponds to the first strut and the second strut remaining in a minimal spread position. In other embodiments in which the one or two caps were placed over one or both ends of the first strut and the second strut with the spreader adjusted to apply a force that would otherwise correspond to an increase above the minimal spread, removal of the one or two caps corresponds to the first strut and the second strut spreading further apart than the minimal spread position.

In some embodiments, a method of extending a finger of a hand comprises step 608 in which the distance between first strut 104 and second strut 106 is increased by increasing extension angle 202 such that a force is exerted by first strut 104 and second strut 106 sufficient to extend the finger, thereby at least partially opening the closed or semi-closed fist. Increasing extension angle 202 is achieved by adjusting loading assembly 124 as described in previous paragraphs.

In some embodiments, increasing extension angle 202 comprises increasing extension angle away from a minimal value. In other embodiments, increasing extension angle 202 comprises increasing extension angle away from a value corresponding to tension preloaded on spring 126 as described in previous paragraphs.

Similarly, in some embodiments in which a first strut and a second strut are separated by a force producible by a spreader, the distance between the first strut and the second strut is increased by adjusting the force produced by the spreader above the force corresponding to the minimal spread. In other embodiments in which a first strut and a second strut are separated by a force producible by a spreader, the distance between the first strut and the second strut is increased by adjusting the force produced by the spreader above the force corresponding to an initial spread above the minimal spread.

In some embodiments, a method of extending a finger of a hand comprises step 610 in which extension angle 202 is decreased such that a force exerted by first strut 104 and second strut on the finger 106 is reduced. Decreasing extension angle 202 is achieved by adjusting loading assembly 124 as described in previous paragraphs.

Similarly, in some embodiments in which a first strut and a second strut are separated by a force producible by a spreader, the distance between the first strut and the second strut is decreased by reducing the force produced by the spreader.

In some embodiments, a method of extending a finger of a hand comprises step 612 in which strap 500 is attached to either one of first strut 104 and second strut 106 at or near a second end. In some embodiments, strap 500 is attached to either one of first strut 104 and second strut 106 away from axis 110. Attaching strap 500 includes any method of securing strap 500 on at least one of first strut 104 and second strut 106 such that a force can be applied to hold first strut 104 and second strut 106 in place relative to a hand. In some embodiments, attaching strap 500 includes wrapping strap 500 around the hand to facilitate holding first strut 104 and second strut 106 in place relative to the hand.

Attaching strap 500 in step 612 includes attaching by the same method used in step 602 or any other method capable of holding first strut 104 and second strut 106 in place relative to the hand. In some embodiments, strap 500 is attached to one of first strut 104 or second strut 106 by passing one of first strut 104 or second strut 106 through a slotted opening in strap 500.

A method of extending a finger of a hand comprises step 614 in which first strut 104 and second strut 106 apply a force to a finger for a period of time. In some embodiments, the force remains constant for the period of time. In other embodiments, the force is either increased or decreased during the period of time.

The period of time is any period sufficiently long to stretch or extend a finger from a flexed position. In some embodiments, the period of time ranges from 5 minutes to 10 hours or from 10 to 120 minutes or from 30 to 60 minutes. Such embodiments are repeated at least once a day over days, weeks, months or longer to stretch the finger to a point where other therapies are effective. In some embodiments, the stretching or extending is performed 1, 2, 3, or 4 times a day for a period ranging from 1 to 365 days or 7 to 180 days or from 30 to 90 days.

In some embodiments, the period of time for stretching or extending the finger corresponds to a period sufficient for treatment or caregiving related to a finger or hand. In some embodiments, treatment or caregiving comprises one or more of trimming fingernails and treating sores. In some embodiments, the period of time ranges from 1 minute to 10 minutes or from 2 to 5 minutes.

A method of extending a finger of a hand comprises step 616 in which first strut 104 and second strut 106 are removed from a closed or semi-closed fist at the end of the period of time corresponding to step 614.

In some embodiments, a method of extending a finger of a hand comprises step 618 in which a series of all or a subset of steps 600 through 616 are repeated. In some embodiments, repeating the steps comprises executing the same series of steps as a previous series of steps. In other embodiments, repeating the steps comprises executing a series of steps that differs from one or more previous series of steps.

Repeating steps comprises repeating steps any number of times. In some embodiments, steps are repeated until a finger is capable to form a c-cup position. In some embodiments, repeating the steps comprises increasing the period of time of step 614 as compared to a preceding execution of some or all steps. In some embodiments, the period of time is increased in increments with a range of 15-30 minutes. In some embodiments, steps are repeated once per day. In some embodiments, steps are repeated more or less often than once per day. In some embodiments, steps are repeated corresponding to treatment or caregiving related to a finger or hand.

Although the embodiments and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of extending at least one finger of a hand substantially fixed in a flexed position, the method comprising:

inserting a system comprising structural elements into the hand, wherein the hand is a closed or semi-closed fisted hand;

thereafter, controlling the structural elements to provide a force sufficient to extend the at least one finger, wherein the force is provided in an adjustable manner over a controllable range; and maintaining the force such that the at least one finger remains extended for a period of time;

wherein the structural elements comprise a spreader, which comprises a first strut and a second strut, wherein the first strut and the second strut pivot about a fulcrum, wherein the first strut and the second strut come together in a narrow tip sufficient to be inserted into the at least one flexed finger of the closed or semi-closed fisted hand, wherein the second strut comprises a loading assembly for adjustably applying the force to rotate the first strut about an extension angle, wherein the method is repeatedly performed for a period of time sufficient to improve the range of motion of at least one joint in a hand or fingers.

2. The method of claim 1, wherein the at least one joint is selected from metacarpophalangeal (MCP) joints, proximal interphalangeal (PIP) joints, and distal interphalangeal (DIP) joints.

3. The method of claim 1, wherein the system is configured to be inserted into a closed fisted hand.

4. The method of claim 1, wherein the system is configured to be inserted into a semi-closed fisted hand.

5. The method of claim 1, wherein the controllable, low-load, prolonged force is providable by at least one mechanism selected from hydraulic pressure mechanisms, bladder mechanisms, spring loaded mechanisms, ratchet mechanisms, collapsible framework mechanisms, and caliper mechanisms.

6. The method of claim 5, wherein the controllable, low-load, prolonged force is providable by a spring loaded mechanism.

7. The method of claim 1, wherein the controllable, low-load, prolonged force is providable by at least one mechanism selected from hydraulic pressure mechanisms, bladder mechanisms, spring loaded mechanisms, ratchet mechanisms, collapsible framework mechanisms, and caliper mechanisms.

8. The method of claim 7, wherein the controllable, low-load, prolonged force is providable by a spring loaded mechanism.

9. The method of claim 1, wherein the structural elements comprise an air bladder, configured to be inserted into the at least one flexed finger of a hand; wherein the controllable, low-load, prolonged force is providable by air inserted into the bladder.

10. A method of extending at least one finger of a hand substantially fixed in a flexed position, the method comprising:

inserting a system comprising structural elements into the hand, wherein the force is provided in an adjustable manner over a controllable range;

thereafter, controlling the structural elements to provide a force sufficient to extend the at least one finger, wherein the force is provided in an adjustable manner over a controllable range; and maintaining the force such that the at least one finger remains extended for a period of time;

wherein the structural elements comprise a spreader, which comprises a first strut and a second strut, wherein the first strut and the second strut pivot about a fulcrum, wherein the first strut and the second strut come together in a narrow tip sufficient to be inserted into the at least one flexed finger of the closed or semi-closed fisted hand, the system comprising:

a cam connected to a spacer, wherein the spacer is connected to the first strut;

the second strut holding a loading assembly, an end piece, and a spring between the loading assembly and the end piece, wherein the end piece is in communication with the cam such that, when in use, the loading assembly compresses or relaxes the spring, which exerts a variable force on the end piece, which rotates the cam and the first strut about an extension angle; and wherein when the extension angle is minimal, the first strut and the second strut are substantially parallel.

11. The method of claim 10, wherein the end piece comprises a chisel tip and the cam has an indentation which, when in use, is contacted by the chisel tip to rotate the first strut.

12. The method of claim 10, wherein the second strut comprises an least partially hollow tube and wherein the second strut holding the loading assembly, the end piece, and the spring comprises the at least partially hollow tube housing the loading assembly, the end piece, and the spring.

13. The method of claim 10, wherein the loading assembly comprises a screw held by the second strut and an intermediate member between the screw and the spring such that, when in use, the screw translates the intermediate member to compress or relax the spring as a function of the rotational position of the screw.

14. The method of claim 10, wherein the first strut comprises a concave surface that allows the first strut to at least partially overlap the second strut when the extension angle is minimal.

15. The method of claim 10, wherein when the extension angle is minimal, the end of the first strut distal to the vertex of the extension angle is approximately aligned with the end of the second strut distal to the vertex of the extension angle.

16. A method of extending at least one finger of a hand substantially fixed in a flexed position, the method comprising:

inserting a system comprising structural elements into the hand, wherein the hand is a closed or semi-closed fisted hand;

thereafter, controlling the structural elements to provide a force sufficient to extend the at least one finger, wherein the force is provided in an adjustable manner over a controllable range; and maintaining the force such that the at least one finger remains extended for a period of time;

wherein the structural elements comprise a spreader, which comprises a first strut and a second strut, wherein the first strut and the second strut pivot about a fulcrum, wherein the first strut and the second strut come together in a narrow tip sufficient to be inserted into the at least one flexed finger of the closed or semi-closed fisted hand, wherein the second strut comprises a loading assembly for adjustably applying the force to rotate the first strut about an extension angle.

17. The method of claim 16, wherein inserting the system comprises inserting the system into an end of the hand nearest the thumb.

18. The method of claim 16, further comprising thereafter performing treatment or caregiving to the hand and/or finger while the at least one finger remains extended.

19. The method of claim 16, further comprising thereafter repeating the method of extending the at least one finger from a flexed position at least once a day for a period of at least one month.

20. The method of claim 16, wherein the second strut further comprises an end piece, and a spring between the loading assembly and the end piece, wherein the end piece is in communication with the first strut such that, when in use, the loading assembly compresses or relaxes the spring, which exerts a variable force on the end piece, which rotates the first strut about the extension angle.

* * * * *